US006467991B1

(12) United States Patent
Joyce et al.

(10) Patent No.: US 6,467,991 B1
(45) Date of Patent: Oct. 22, 2002

(54) PROCESS AND MATERIAL FOR PREVENTING CONTAMINATION AND EROSION OF GOLF COURSE SAND TRAPS

(76) Inventors: James T. Joyce, 378 Brunswick Dr., Waynesville, NC (US) 28785; Tim Johnson, 3910 Urbandale La., Plymouth, MN (US) 55446

( * ) Notice: Subject to any disclaimer, the term of this patent is extended or adjusted under 35 U.S.C. 154(b) by 0 days.

(21) Appl. No.: 09/610,080

(22) Filed: Jul. 5, 2000

Related U.S. Application Data

(60) Provisional application No. 60/143,033, filed on Jul. 9, 1999.

(51) Int. Cl.[7] ..... A63C 19/00; E02B 11/00

(52) U.S. Cl. ..... 404/76; 404/75; 405/38

(58) Field of Search ..... 405/38, 36; 404/75, 404/76, 90

(56) References Cited

U.S. PATENT DOCUMENTS

| | | | | | |
|---|---|---|---|---|---|
| 278,031 | A | | 5/1883 | McKinley | |
| 1,591,378 | A | * | 7/1926 | Hansen | |
| 3,719,050 | A | * | 3/1973 | Asao et al. | 61/36 R |
| 3,900,687 | A | * | 8/1975 | Meader, Jr. et al. | 428/425 |
| 4,182,700 | A | | 1/1980 | Benton et al. | |
| 4,960,345 | A | * | 10/1990 | Hurley et al. | 405/38 |
| 5,114,275 | A | * | 5/1992 | West et al. | 405/128 |
| 5,147,156 | A | * | 9/1992 | Guettler et al. | 406/197 |
| 5,306,759 | A | * | 4/1994 | Sakagami et al. | 524/379 |
| 5,567,793 | A | * | 10/1996 | Slack et al. | 528/69 |
| 5,641,584 | A | | 6/1997 | Andersen et al. | |
| 5,678,369 | A | | 10/1997 | Ishikawa et al. | |
| 5,715,637 | A | | 2/1998 | Hesterman et al. | |
| 5,733,952 | A | | 3/1998 | Geoffrey | |
| 5,795,108 | A | * | 8/1998 | Lightle | 406/48 |
| 5,877,227 | A | * | 3/1999 | Murty | 521/159 |
| 5,885,025 | A | | 3/1999 | Angley et al. | |

* cited by examiner

*Primary Examiner*—Thomas B. Will
*Assistant Examiner*—Raymond W. Addie
(74) *Attorney, Agent, or Firm*—Carter & Schnedler, P.A.

(57) ABSTRACT

A method for treating golf course sand traps to reduce contamination of the sand and to reduce erosion. The bottom of the trap, which is substantially devoid of playing sand is roughened. An initial amount of hydrophobic liquid polyurethane is applied to the roughened soil on the bottom of the trap. The trap is raked and an additional amount of hydrophobic liquid polyurethane is applied to the bottom of the trap. A thin layer of sand is applied to the bottom of the trap and a further additional amount of hydrophobic liquid polyurethane is applied to the sand and the sand is raked. The thin layer of sand is sprayed with water and the trap is permitted to cure for approximately 24 hours. A sufficient amount of playing sand is then added to the trap so the trap is playable.

12 Claims, No Drawings

PROCESS AND MATERIAL FOR PREVENTING CONTAMINATION AND EROSION OF GOLF COURSE SAND TRAPS

CROSS-REFERENCE TO PROVISION PATENT APPLICATION

The benefit of U.S. Provisional Patent Application Serial No. 60/143,033, filed Jul. 9, 1999, is claimed.

BACKGROUND OF THE INVENTION

This invention relates to golf course sand traps. More particularly, it relates to a method and material for preventing contamination and erosion of golf course sand traps.

One problem associated with golf course sand traps is the contamination of the sand, primarily, due to mud, dirt and stones moving through the sand from the bottom of the sand trap. This results in unsightly discoloration of the sand. In addition, this can change the consistency of the sand, resulting in poor shots by golfers from the sand trap.

Another problem associated with golf course sand traps is erosion around the edges of the sand trap, particularly, where the edges are steep.

OBJECTS OF THE INVENTION

It is therefore one object of this invention to provide a method and material for preventing contamination and erosion of golf course sand traps.

SUMMARY OF THE INVENTION

In accordance with one form of this invention there is provided a method for treating golf course sand traps to reduce contamination of the sand and to reduce erosion. The soil on the bottom of the trap, which is substantially devoid of playing sand, is roughened. As used herein, "playing sand" means the sand which is placed in the trap to affect the golfers shot and does not mean sand which naturally occurs with the soil in the bottom of the trap. An initial amount of hydrophobic liquid polyurethane is applied to the roughened soil on the bottom of the trap. A sufficient amount of playing sand is added to the trap so that the sand is playable. Preferably, the bottom of the trap is raked after the initial amount of hydrophobic liquid polyurethane is applied to the roughened soil. It is also preferred that a small amount of sand is added to the bottom of the trap sufficient to completely cover the bottom of the trap with a thin layer and that an additional amount of hydrophobic liquid polyurethane is applied to the thin layer of sand. It is also preferred that the thin layer of sand is sprayed with water and the treated trap is then permitted to cure preferably for approximately 24 hours. It is also preferred that the hydrophobic liquid polyurethane comprise between 50 and 100 weight percent polymeric 4, 4' diphenylmethane diisocyanate preferably containing a minimum functionality of 2.0, 0 to 50 weight percent of an alkaline carbonate, such as propylene carbonate, 0 to 1 weight percent of a urethane catalyst, such as zirconium chelate, and 0 to 2 weight percent of a silicone surfactant.

DETAILED DESCRIPTION

It has been found that by applying a hydrophobic polyurethane in liquid form to the base of a golf course sand trap, the probability that the sand, which is placed over the base, will become contaminated by the soil from the base is substantially reduced. In addition, the application of the hydrophobic polyurethane to the base causes the edges around the sand trap to become highly stabilized.

The preferred hydrophobic liquid polyurethane is Klingstone 40, formerly known as Mountain Grout Soil Stabilizer, which is commercially available from Green Mountain International, Inc., of Waynesville, N.C. The composition of the hydrophobic liquid polyurethane may vary. However, the preferred formulation is 89.5 weight percent of polymeric 4, 4' diphenylmethane diisocyanate containing a minimum functionality of 2.0, 10% weight percent of an alkaline carbonate, such as propylene carbonate, and approximately 0.01 weight percent of a urethane catalyst, such as zirconium chelate, which may be amine based or organometallic based, and approximately 0.5 weight percent of a silicone surfactant. It is believed that other compositions of hydrophobic liquid polyurethane will work so long as the composition will lock soil particles together forming a somewhat permanent and substantially impervious solid mass. It is believed that the following ranges of materials from the specific composition described above will perform that function: 50 to 100 weight percent of polymeric 4, 4' diphenylmethane diisocyanate, 0 to 50 weight percent of an alkaline carbonate, such as propylene carbonate, 0 to 1 weight percent of a urethane catalyst, such as zirconium chelate, and 0 to 2 weight percent of a silicone surfactant. It is preferred that the liquid polyurethane material be low viscosity and be a single component hydrophobic polyurethane system.

In general, the material described above is used by spraying it to the soil which forms the base of a golf course sand trap and then adding the sand to the trap. The preferred method of utilizing the material described above on sand traps is set forth below.

1. With substantially all of the playing sand removed from the sand trap, the base of the trap is prepared in the normal fashion by digging drainage ditches in the bottom of the trap.
2. The bottom of the trap is then scarified, i.e., roughed up, by raking the bottom of the trap.
3. The scarified soil is saturated with the polyurethane material described above by spraying the soil stabilizer material onto the soil.
4. The trap is then raked again.
5. The polyurethane material is reapplied to the bottom of the trap.
6. Approximately a one inch layer of sand is applied to the bottom of the trap.
7. An additional amount of the polyurethane material is applied to the trap and is raked in.
8. The bottom of the trap is sprayed with water.
9. The treated trap is then permitted to cure for approximately 24 hours.
10. The remaining playing sand is added to the trap.

By using the method described above, it has been found that the sand in golf course sand traps no longer becomes contaminated by the soil from the base of the trap. In addition, erosion around the edges of the sand trap has been substantially reduced.

From the foregoing description of one embodiment of the invention, it will be apparent that many modifications may be made therein. It will be understood that this embodiment of the invention is an exemplification of the invention only and that the invention is not limited thereto.

What is claimed is:

1. A method for treating golf course sand traps to reduce contamination of the playing sand and to reduce erosion comprising the steps of:

roughening the soil on the bottom of the trap which is substantially devoid of playing sand;

applying an initial amount of hydrophobic liquid polyurethane to the roughened soil on the bottom of the trap; and adding an amount of playing sand to the trap; whereby the likelihood of contamination of the sand by the soil and erosion of the trap is substantially reduced.

2. A method as set forth in claim 1, further including the steps of raking the bottom of the trap after the initial amount of hydrophobic liquid polyurethane is applied to the roughened soil;

applying an additional amount of hydrophobic liquid polyurethane to the bottom of the trap; and adding an amount of sand to the bottom of the trap sufficient to completely cover the bottom of the trap with a thin layer; and applying a further additional amount of hydrophobic liquid polyurethane to the thin layer of sand.

3. A method as set forth in claim 2, further including the steps of spraying the thin layer of sand with water, and permitting the treated trap to cure.

4. A method as set forth in claim 3, further including the step of digging drainage ditches in the bottom of the trap prior applying the initial amount of hydrophobic liquid polyurethane.

5. A method as set forth in claim 4, further including the step of raking the sand in the trap after the further additional amount of hydrophobic liquid polyurethane is applied to the thin layer of sand.

6. A method as set forth in claim 5, wherein the hydrophobic liquid polyurethane is applied by spraying.

7. A method as set forth in claim 6, wherein the treated trap is permitted to cure for approximately 24 hours.

8. A method as set forth in claim 1, wherein the hydrophobic liquid polyurethane comprises 50 to 100 weight percent polymeric 4, 4' diphenylmethane diisocyanate, 0 to 50 weight percent of propylene carbonate, 0 to 1 weight percent of zirconium chelate, and 0 to 2 weight percent of a silicone surfactant.

9. A method as set forth in claim 8, wherein the hydrophobic liquid polyurethane comprises 89.5 weight percent polymeric 4, 4' diphenylmethane diisocyanate, 10 weight percent of propylene carbonate, approximately 0.01 weight percent of zirconium chelate, and approximately 0.5 weight percent of a silicone surfactant.

10. A method for treating golf course sand traps to reduce contamination of the playing sand and to reduce erosion comprising the steps of:

digging drainage ditches in the bottom of the trap;

roughening the soil on the bottom of the trap which is substantially devoid of sand;

saturating the roughened soil on the bottom of the trap with an initial amount of hydrophobic liquid polyurethane;

raking the hydrophobic liquid polyurethane saturated soil;

applying an additional amount of hydrophobic liquid polyurethane to the raked soil;

adding a thin layer of sand to the bottom of the trap;

applying a further additional amount of hydrophobic liquid polyurethane to the thin layer of sand;

spraying the thin layer of sand with water;

permitting the treated trap to cure;

adding a n amount of playing sand to the trap; whereby the likelihood of contamination of the sand by the soil and erosion of the trap is substantially reduced.

11. A method as set forth in claim 10, wherein the hydrophobic liquid polyurethane comprises 50 to 100 weight percent polymeric 4, 4' diphenylmethane diisocyanate, 0 to 50 weight percent of propylene carbonate, 0 to 1 weight percent of zirconium chelate, and 0 to 2 weight percent of a silicone surfactant.

12. A method as set forth in claim 11, wherein the hydrophobic liquid polyurethane comprises 89.5 weight percent polymeric 4, 4' diphenylmethane diisocyanate, 10 weight percent of propylene carbonate, approximately 0.01 weight percent of zirconium chelate, and approximately 0.5 weight percent of a silicone surfactant.

* * * * *